United States Patent [19]

Leone et al.

[11] Patent Number: 4,899,022

[45] Date of Patent: Feb. 6, 1990

[54] STORED ENERGY OPERATING MECHANISM CHARGING HANDLE AND COVER ASSEMBLY

[75] Inventors: David A. Leone; G. Lawrence Moody, both of Lawrenceville; William D. Holland, Stone Mountain; Mark E. Bell, Atlanta; W. Dale Robbins, Snellville, all of Ga.

[73] Assignee: Siemens Energy & Automation, Inc., Alpharetta, Ga.

[21] Appl. No.: 256,356

[22] Filed: Oct. 11, 1988

[51] Int. Cl.[4] ..... H01H 9/20; H01H 5/00

[52] U.S. Cl. ..... 200/50 A; 200/400

[58] Field of Search ..... 200/50 R, 50 A, 400, 200/401, 318, 318.1, 318.2, 322-325, 330

[56] References Cited

U.S. PATENT DOCUMENTS

| | | | |
|---|---|---|---|
| 3,095,489 | 6/1963 | Baird | 200/400 |
| 3,343,109 | 9/1967 | Jencks et al. | 337/54 X |
| 3,770,922 | 11/1973 | Gryctko | 200/146 R |
| 3,848,102 | 11/1974 | Jencks et al. | 200/400 |
| 3,876,847 | 4/1975 | Dykes et al. | 200/400 |
| 4,251,702 | 2/1781 | Castonguay et al. | 200/400 |
| 4,295,022 | 10/1981 | Robins | 200/147 R |
| 4,336,516 | 6/1982 | Bratkowski et al. | 335/171 |
| 4,475,021 | 10/1984 | Mochizuki et al. | 200/400 |
| 4,742,200 | 5/1988 | Marquardt et al. | 200/325 |
| 4,750,375 | 6/1988 | Godesa | 74/2 |

*Primary Examiner*—J. R. Scott

*Attorney, Agent, or Firm*—James G. Morrow

[57] ABSTRACT

A charging handle assembly for charging the closing springs of a stored energy mechanism which closes the contacts of a circuit breaker. The charging handle has a generally U-shape and is pivotally attached to the circuit breaker cover. The handle is adapted to cooperate with the stored energy mechanism such that the cover and handle are easily removed from the circuit breaker. Additionally, the handle cooperates with the cover and the stored energy mechanism so that energy is transferred to the springs of the mechanism by pumpiing the handle.

6 Claims, 5 Drawing Sheets

STORED ENERGY OPERATING MECHANISM CHARGING HANDLE AND COVER ASSEMBLY

CROSS-REFERENCE TO RELATED APPLICATIONS

This patent application is related to the patent application entitled STORED ENERGY OPERATING MECHANISM having U.S. patent application Ser. No. 07/255,894 filed concurrently herewith.

BACKGROUND OF INVENTION

This invention relates to a circuit breaker, and more particularly, to a circuit breaker cover assembly including a handle for charging the operating mechanism of the circuit breaker.

Various forms of handle assemblies for charging operating mechanisms of circuit breakers have been used. For example, U.S. Pat. No. 4,475,021 disclosed a handle operable to accumulate energy in an energy accumulating spring. One of the problems with certain previous mechanisms is that the handle on the mechanism was arranged and configured such that operating the handle was difficult unless the circuit breaker happened to be in a convenient location. This arrangement can create a dangerous situation since the handle can snap back and injure the operator if the handle is released before charging is complete. Another problem with certain previous mechanisms is that the handle must be removed to remove the circuit breaker cover. For some of these mechanisms, the handle can be replaced without replacing circuit breaker cover. Thus, a dangerous situation could be created wherein the circuit breaker could be charged without the cover being in place.

SUMMARY OF THE INVENTION

An object of the present invention is to provide a charging handle assembly which is configured such that the handle can be conveniently operated from a number of positions relative to the circuit breaker. Another object of the present invention is to provide an assembly which prevents the circuit breaker from being charged when the circuit breaker cover is removed.

Accordingly, there is provided a circuit breaker comprising at least one pair of primary contacts, means for storing energy, a circuit breaker case including a cover, and a handle pivotally mounted to the cover including means for transferring energy to the means for storing energy. When the handle is pivoted, energy is transferred to the means for storing energy and this energy is ultimately used to close the primary contacts. The contacts and means for storing energy are positioned within the circuit breaker case.

An advantage of the present invention is that it provides a charging handle cover arrangement wherein the handle does not protrude excessively from the cover of the circuit breaker, and openings between handle and cover working surfaces are minimized. Another advantage of the present invention is that the mechanism is adapted to give the handle free-play to allow the user to firmly grasp the charging handle before encountering resistance from the charging mechanism. Another advantage of the present invention is that it can be adapted to include means for preventing closure of the circuit breaker while the charging handle is not within its stored position, and means for preventing removal of the charging handle from its stored position while the close button is depressed.

Various other objects and advantages of the present invention will become apparent from the following description, with reference to the accompanying drawing.

DETAILED DESCRIPTION OF THE PREFERRED EMBODIMENT

Figure 1:
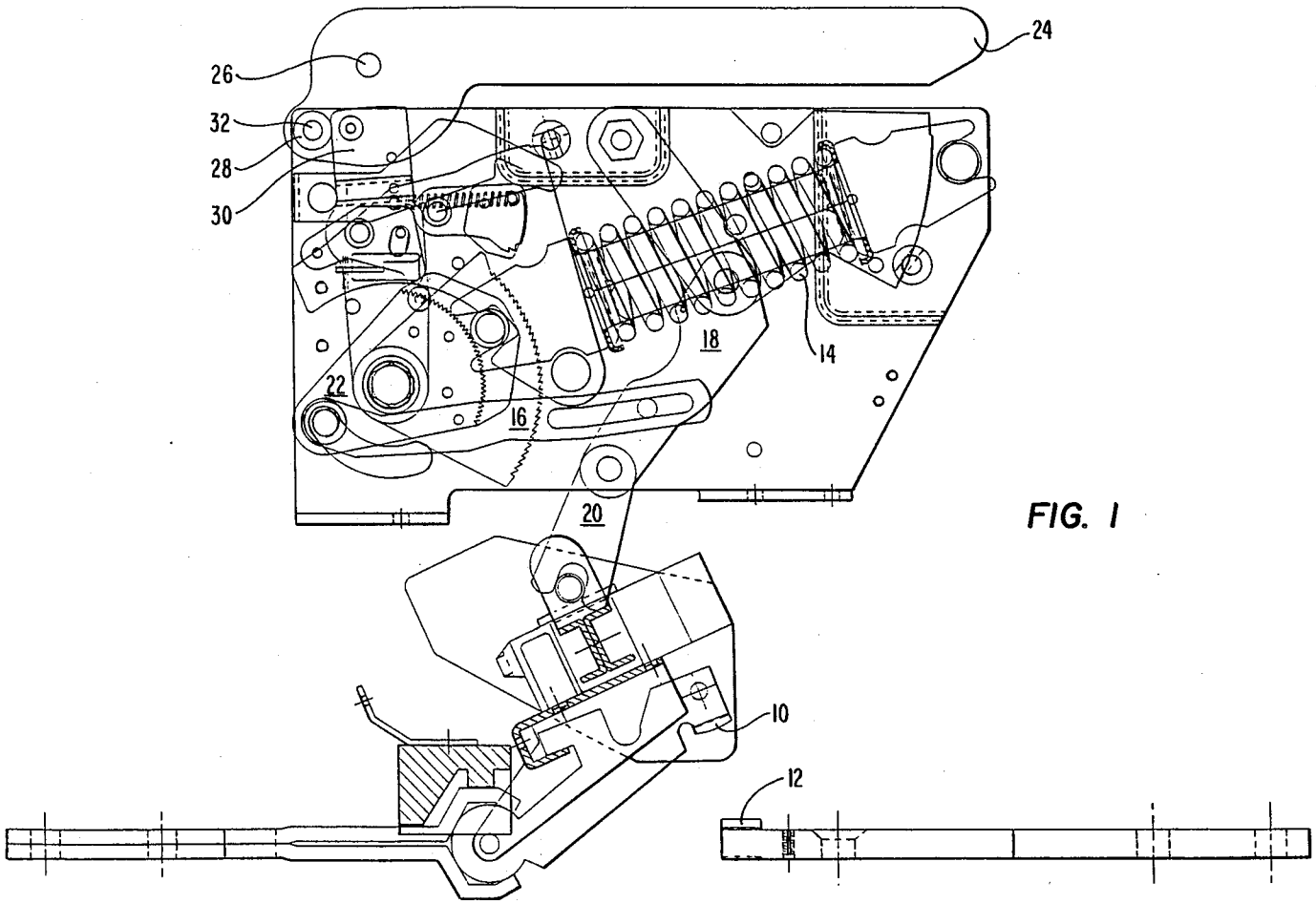
FIG. 1 is a side view of a charging handle in combination with of a circuit breaker charging mechanism with the contacts open and the closing spring in a charged position.
Figure 2:
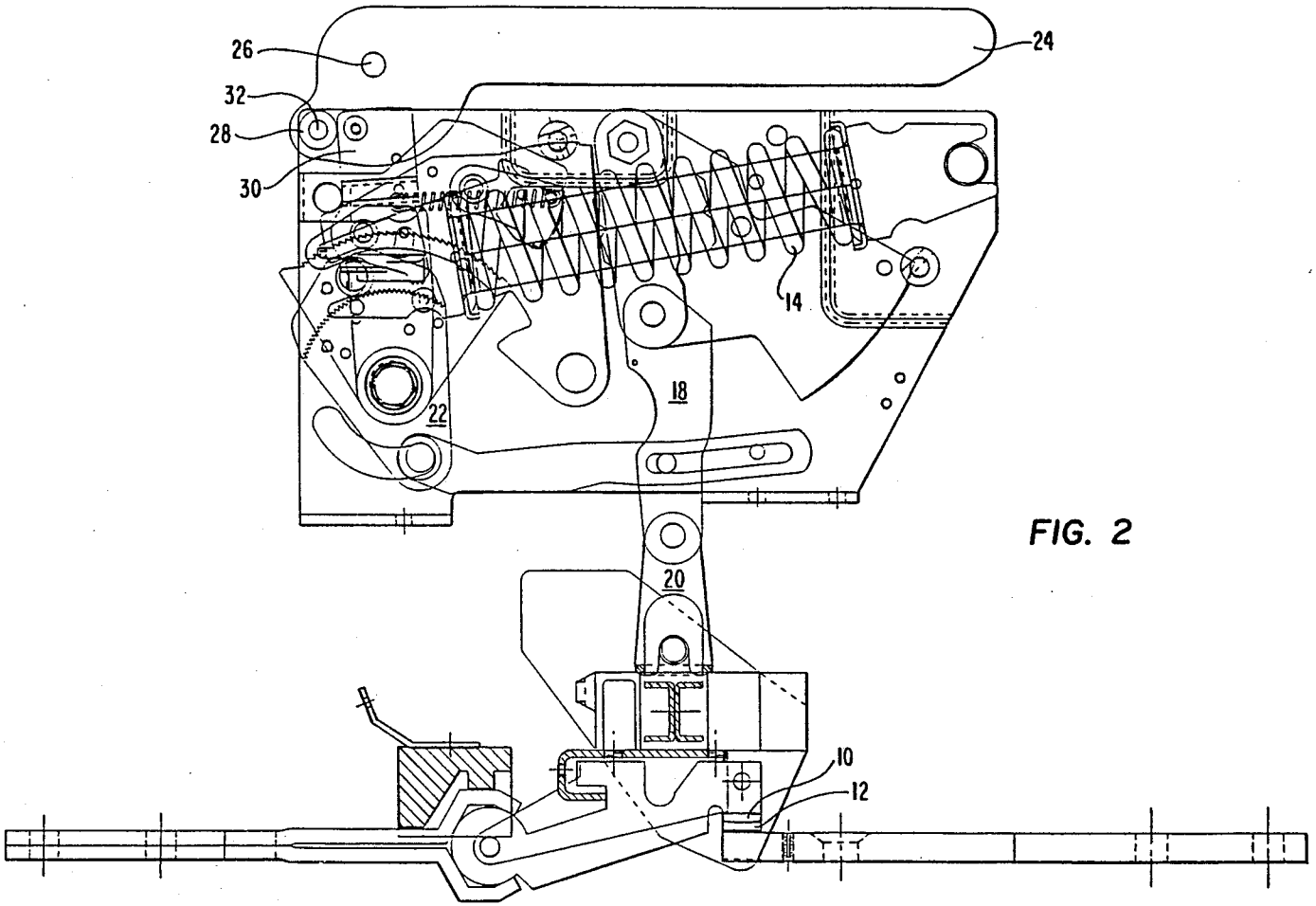
FIG. 2 is a side view of a charging handle in combination with a circuit breaker charging mechanism with the contacts closed and the closing spring in an uncharged position.
Figure 3:
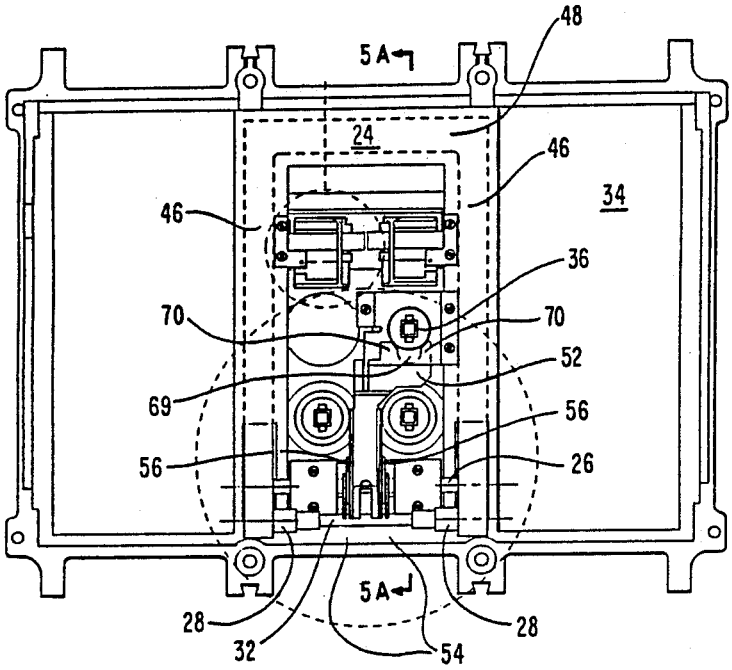
FIG. 3 is a front view of a charging handle in combination with the circuit breaker case and cover.
Figure 4:
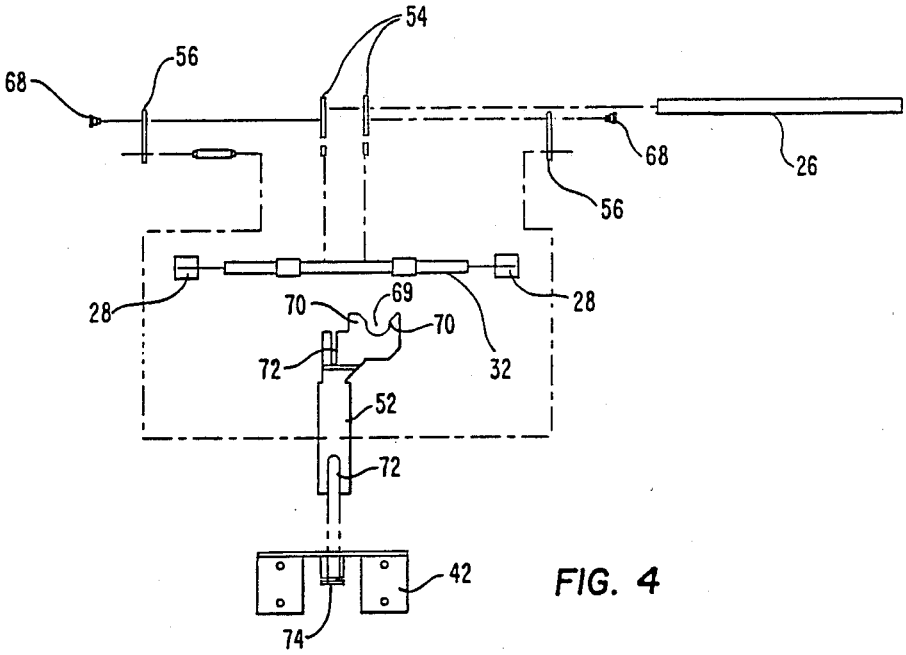
FIG. 4 is a front exploded view of some of the operative parts of the assembly.
Figure 5:
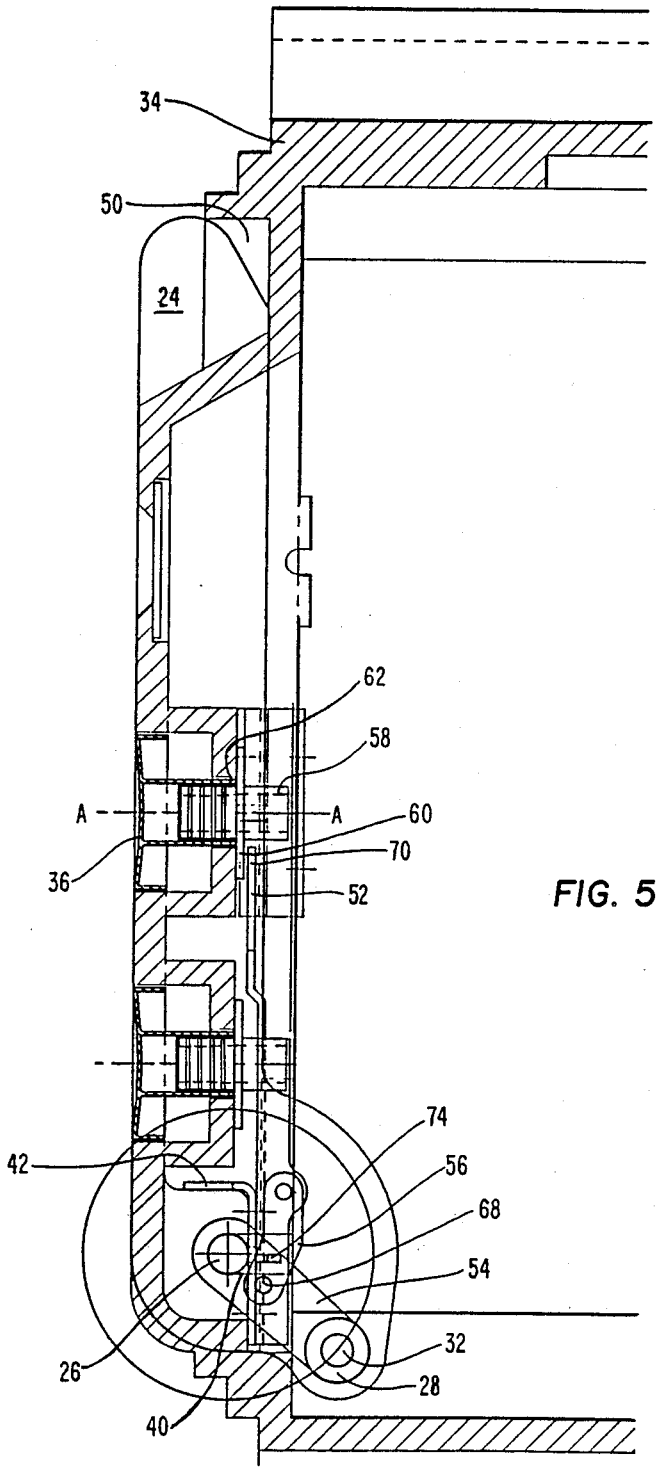
FIG. 5 is a side partial side view of the charging handle assembly.
Figure 5A:
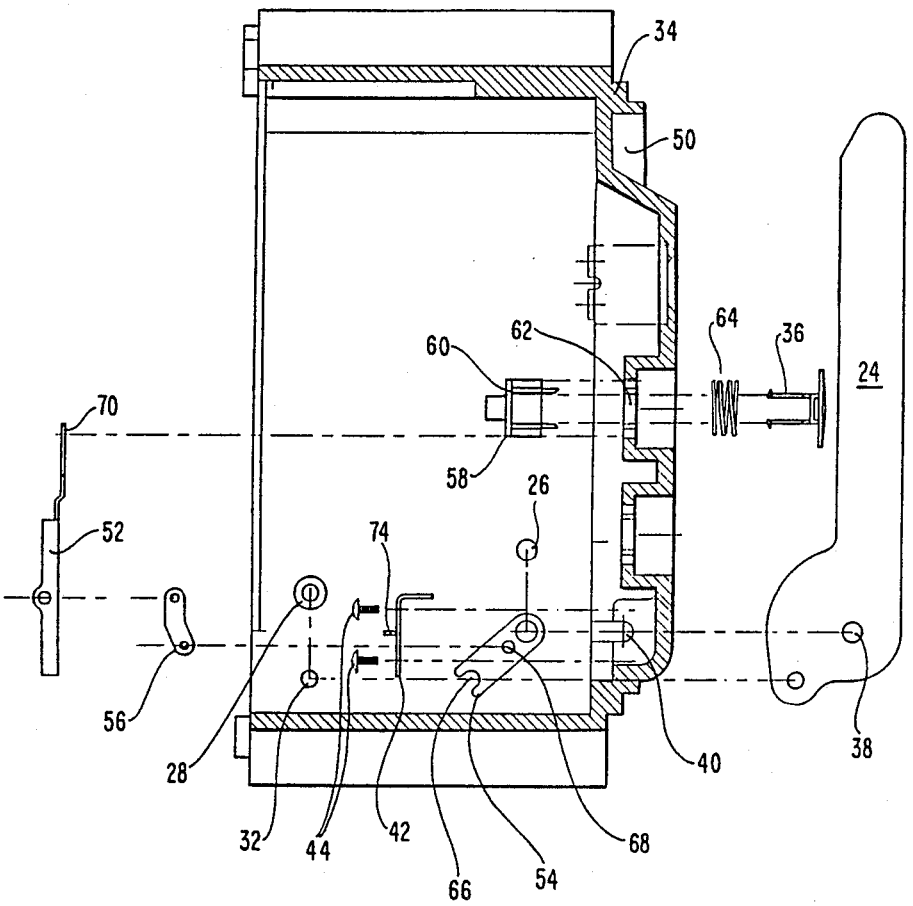
FIG. 5*a* is a side exploded view of some of the operative parts of the assembly taken along line 5A—5A of FIG. 3.

FIGS. 1 and 2 each illustrate one half of the stored energy mechanism of a circuit breaker. The other half (not shown) is the mirror image of the mechanism illustrated in FIGS. 1 and 2. This mechanism is described in detail in the patent application entitled STORED ENERGY OPERATING MECHANISM having U.S. paten application Ser. No. 07/255,894 filed concurrently herewith. In FIG. 1, the primary contacts 10, 12 are in their open position and the spring 14 is in its charged or stored energy state. FIG. 2 illustrates the primary contacts 10, 12 in their closed position and the spring 14 in its discharged state. To close the contacts 10, 12, the stored energy of the spring 14 is utilized by the closing mechanism which includes the links 16, 18, 20 and a rotating member 22.

FIGS. 1 and 2 also illustrate a handle 24 used for transferring energy to the spring 14 of the stored energy mechanism. When the handle 24 is rotated about the shaft 26, the drive bearing 28 of the handle 24 acts against the arm 30 to rotate the arm 30 in the clockwise direction. To optimize the cooperation between the bearing 28 and the arm 30, the bearing 28 rotates upon a bearing shaft 32. The arm 30 cooperates with a group of pawls and ratcheting surfaces to rotate the rotating member 22 in the clockwise direction. As the member 22 is rotated in the clockwise direction, the spring 14 is charged.

FIGS. 3–5*a* illustrate the preferred embodiment of the charging handle and cover assembly in more detail. In general, the assembly includes a charging handle 24, a cover 34 for the circuit breaker, a pushbutton 36 for initiating the closing of the primary contacts 10, 12 and an interlock system. The handle 24 pivots on a shaft 26 which passes through the shaft openings 38 of the handle 24. The shaft 26 is fixed within slots 40 in the cover 34 by a bracket 42 held in place with fasteners 44.

The handle 24 includes side members 46 and a handle grip member 48. The handle 24 rests partially within a recess 50 within the cover 34 to advance a compact configuration when the handle 24 is in its stored postion. To ensure that the grip 48 can be partially withdrawn from the recess 50 and firmly held before the arms 30 fully engage the charging mechanism, the interaction between the drive bearings 28 and arms 30 is designed to allow free play between the arms 30 and the operating mechanism.

In general, the interlock system includes a sliding interlock member 52, drive links 54, and intermediate links 56. The pushbutton 36 includes a member 58 which includes a circumferential ridge 60 adapted to cooperate with the interlock member 52. The pushbutton 36 and member 58 cooperate with an opening 62 such that the pushbutton 36 translates along line A—A within the opening 62. A biasing spring 64 is provided to bias the pushbutton 36.

The interlock system operates to prevent the pushbutton 36 from being depressed against the biasing force of the spring 64 when the handle 24 is pivoted away from the cover. The interlock system also prevents the handle 24 from being pivoted away from the cover when the pushbutton 36 is depressed. The drive link 54 is mounted on the shaft 26 and has a saddle 66 which straddles the bearing shaft 32 so that when the handle 24 is pivoted from the cover, the pivot 68 is moved upward. The pivot 68 causes the intermediate links 56, which are pivotally attached to the interlock member 52 and the drive links 54, to slide the interlock member 52 upwardly. When the interlock member 52 is slid upward, the fingers 70 interfere with the ridge 60 such that pushbutton 36 can not be depressed. To provide the sliding motion of the interlock member 52, the member 52 is provided with grooves 72 which slidably engage the cover 34 and the slide hook 74 of the bracket 42.

When the pushbutton 36 is depressed, the ridge 60 interferes with the depression 69 between the fingers 70 of the interlock member 52 to prevent the member from moving upwardly. Accordingly, the links 54, 56 and the interlock member 52 cooperate to prevent the handle from being pivoted from its stored position.

While one embodiment of a charging handle and cover assembly has been shown and described in detail herein, various other changes and modifications may be made without departing from the scope of the present invention.

We claim:

1. A circuit breaker comprising:

at least one pair of primary contacts;

means for storing energy, wherein the energy is used to close the primary contacts;

a circuit breaker case including a cover, wherein the contacts and means for storing energy are positioned within the case;

a handle pivotally mounted to the cover including means for transferring energy to the means for storing energy, wherein energy is transferred to the means for storing energy when the handle is pivoted from a first position;

means for initiating being activatable such that the closing of the primary contacts is initiated, the means for initiating being mounted to the cover; and means for interlocking the means for initiating with the handle such that the means for initiating is restricted from being activated when the handle is pivoted from the first position.

2. The circuit breaker of claim 1, wherein the means for initiating comprises a translatable push button including an engagement means, and the means for interlocking comprises a member adapted to cooperate with the engagement means to prevent the push button from translating, the member and handle cooperating such that the member is caused to cooperate with the engagement means when the handle is pivoted.

3. The circuit breaker of claim 2, wherein the handle has a generally U-shape including two side members and a handle grip member.

4. A charging handle and circuit breaker cover assembly for a circuit breaker of the type including at least one pair of primary contacts, means for storing energy, wherein the energy is used to close the primary contacts, and a case, the assembly comprising:

a cover engageable with the case;

a handle pivotally mounted to the cover including means for transferring energy to the means for storing energy, wherein energy is transferred to the means for storing energy when the handle is pivoted from a first position;

means for initiating being activatable such that the closing of the primary contacts is initiated, the means for initiating being mounted to the cover; and means for interlocking the means for initiating with the handle such that the handle is restricted from being pivoted when the means for initiating is activated and the means for initiating is restricted from being activated when the handle is pivoted from the first position.

5. The assembly of claim 4, wherein the means for initiating comprises a translatable push button including an engagement ridge, and the means for interlocking comprises a member adapted to engage the engagement ridge to prevent the push button from translating, the member and handle cooperating such that the member is caused to engage the engagement ridge when the handle is pivoted.

6. The assembly of claim 5, wherein the handle has a generally U-shape including two side members and a handle grip member.

* * * * *